US007147179B2

(12) United States Patent
Nakagawa et al.

(10) Patent No.: US 7,147,179 B2
(45) **Date of Patent: *Dec. 12, 2006**

(54) REINFORCEMENT BINDING MACHINE AND REEL USED FOR THE MACHINE

(75) Inventors: Yasushi Nakagawa, Tokyo (JP); Noboru Ishikawa, Tokyo (JP); Ichiro Kusakari, Tokyo (JP)

(73) Assignee: Max Kabushiki Kaisha, Tokyo (JP)

( * ) Notice: Subject to any disclaimer, the term of this patent is extended or adjusted under 35 U.S.C. 154(b) by 98 days.

This patent is subject to a terminal disclaimer.

(21) Appl. No.: 10/491,003

(22) PCT Filed: Sep. 30, 2002

(86) PCT No.: PCT/JP02/10189

§ 371 (c)(1),
(2), (4) Date: Sep. 27, 2004

(87) PCT Pub. No.: WO03/028918

PCT Pub. Date: Apr. 10, 2003

(65) Prior Publication Data

US 2005/0087646 A1 Apr. 28, 2005

(30) Foreign Application Priority Data

Sep. 28, 2001 (JP) ..... 2001-304114

(51) Int. Cl.
*B65H 49/26* (2006.01)

(52) U.S. Cl. ..... 242/597.6; 242/597.3; 242/599.4; 242/611; 242/613

(58) Field of Classification Search ..... 242/599.4, 242/611, 611.1, 611.2, 597.2, 597.3, 597.6, 242/613; 140/57, 119
See application file for complete search history.

(56) References Cited

U.S. PATENT DOCUMENTS

| | | | | |
|---|---|---|---|---|
| 1,655,299 | A * | 1/1928 | Thornton | 242/597.6 |
| 2,683,000 | A | 7/1954 | Beiderwell | |
| 3,191,741 | A * | 6/1965 | Landgraf | 242/597.6 |
| 3,512,734 | A * | 5/1970 | Priest | 242/611.2 |
| 3,620,468 | A * | 11/1971 | St. Amour | 242/597.6 |
| 3,735,941 | A * | 5/1973 | Brown et al. | 242/597.6 |
| 4,316,759 | A * | 2/1982 | Becker et al. | |
| 4,545,550 | A * | 10/1985 | Wolf et al. | 242/597.6 |

(Continued)

FOREIGN PATENT DOCUMENTS

EP 0 908 582 A1 4/1999

(Continued)

OTHER PUBLICATIONS

Supplemental European Patent Office Search Report.

*Primary Examiner*—William A. Rivera
(74) *Attorney, Agent, or Firm*—Buchanan Ingersoll & Rooney PC

(57) ABSTRACT

A reinforcement binding machine (20) capable of binding reinforcement (22) by winding wire (27) in loop shape around the reinforcement (22), wherein irregular parts (43) are formed on the peripheral surface of a reel mounting shaft (40), an engagement claw (47) is formed on the inner peripheral surface of a hub hole (46) of the reel (38), and an engagement part (48) engaged with the irregular parts (43) to prevent the reel (38) from racing is formed at the tip part of the engagement claw (47), whereby the reel can be prevented from racing while allowing the reel to rotate in normal and reverse directions so as to eliminate the occurrence of entanglement of the wire.

6 Claims, 13 Drawing Sheets

U.S. PATENT DOCUMENTS

| | | | | | |
|---|---|---|---|---|---|
| 4,629,140 | A | * | 12/1986 | LaCasse | 242/611.2 |
| 4,651,943 | A | * | 3/1987 | Kawaguchi | 242/597.6 |
| 5,150,851 | A | * | 9/1992 | Manusch et al. | 242/599.4 |
| 5,947,166 | A | | 9/1999 | Doyle et al. | |

FOREIGN PATENT DOCUMENTS

| | | | | |
|---|---|---|---|---|
| EP | 0 908 582 B1 | | | 7/2003 |
| JP | 6-190482 | | | 7/1994 |
| JP | 6-226386 | | | 8/1994 |
| JP | 9-240927 | | * | 9/1997 |
| JP | 11-104777 | A | | 4/1999 |
| JP | 11-156748 | | | 6/1999 |
| JP | 2002-225813 | | | 8/2002 |

* cited by examiner

PRIOR ART

PRIOR ART

REINFORCEMENT BINDING MACHINE AND REEL USED FOR THE MACHINE

TECHNICAL FIELD

The present invention relates to a reinforcement binding machine for fixedly binding, for example, reinforcing bars crossing each other with a wire, and more specifically to a reinforcement binding machine in which the wire is prevented from being entangled as the wire is fed more than necessary at the time of wire feeding, and to a reel used for the machine.

BACKGROUND ART

Regarding a mechanism for preventing entanglement of wire wound around a reel of a reinforcement binding machine, JP 11-104777 A, filed by the present applicant, discloses a "Brake Mechanism of Wire Reel for Reinforcing Bar Binding Machine".

In this reinforcement binding machine, the rotation of the wire reel is braked substantially simultaneously with the completion of wire feeding, thereby preventing wire entanglement due to idle running of the reel.

FIG. 12 shows this reinforcement binding machine, in which a reel 2 around which a wire 3 is wound is retained at the rear of a reinforcement binding machine 1. The wire 3 drawn out of the reel 2 is fed to the front portion of the reinforcement binding machine 1 by a wire feeding means 5, and is curled as it is fed along a guide 6 having an arcuately extending groove to be formed into a loop around reinforcing bars 7 crossing each other in a cross-like form. The wire 3 wound around the reinforcing bars 7 in a loop-like form is grasped by a grasping portion 4, and then the wire feeding by the wire feeding means 5 stops; further, a twisting hook 8 having at its forward end a groove for holding the wire 3 in a loop-like form approaches the wire 3, which is inserted into the groove. Thereafter, the twisting hook 8 rotates to twist the wire 3 to thereby bind the reinforcing bars 7, and then the wire 3 is cut by a cutting means provided in the grasping portion 4, which then releases the wire 3.

FIG. 13 shows a brake mechanism for preventing idle running of the reel 2 of the reinforcement binding machine 1. A mounting shaft (not shown) retaining the reel 2 is provided in the reinforcement binding machine 1, and a gear 10 is attached to a side portion of the reel 2. Formed in the periphery of the gear 10 are engagement recesses 11 allowing rotation in one direction, and in the vicinity of the engagement recesses 11, there is arranged a brake claw 12 consisting of a latch claw. The brake claw 12 is supported by a base 13, which is rotatably supported by a shaft 14 provided on the binding machine main body 1. The base 13 is urged by a spring 15 such that the brake claw 12 is pressed against the gear 10, allowing the gear 10 to rotate counterclockwise as seen in the drawing and prohibiting clockwise rotation of the gear 10.

The above-described reinforcement binding machine 1 is of the type which, after feeding out the wire 3, allows rotation of the wire 3 in one direction only.

Recently, however, there is a demand for a reinforcement binding machine which, after feeding out the wire 3 and winding it around the reinforcing bars 7, pulls back the wire 3 from the reinforcing bar 7 side to thereby achieve a reduction in the consumption amount of the wire 3, and in the brake mechanism of the type described above, returning of the wire 3 cannot be effected.

Further, if, during forward feeding of the wire 3 toward the reinforcing bar 7 side or reverse feeding thereof from the reinforcing bar 7 side, the reel 2 makes idle running, there is a fear of the wire 3 loosened on the reel 2 being entangled.

The present invention has been made in view of the above problems. It is an object of the present invention to provide a construction in which, when the feeding force or tightening force for the wire is canceled and the tensile force for the wire is weakened, idle running of the reel is prevented to eliminate generation of wire entanglement on the reel while allowing the reel to rotate in both the normal and reverse directions.

DISCLOSURE OF THE INVENTION

To attain the above object, in accordance with the invention as claimed in claim 1 of the present application, there is provided a reinforcement binding machine in which a reel mounting shaft is formed in one of a binding machine main body and a case mounted to the binding machine main body and in which a reel around which a wire for binding reinforcing bars is wound is attached to the reel mounting shaft, the reinforcing bars being bound by the wire fed out from the reel, characterized in that: on a peripheral surface of the reel mounting shaft, there is formed a portion to be engaged consisting of at least one of a recess and a protrusion; on an inner peripheral surface of a hub hole into which the reel mounting shaft of the reel is inserted, there is formed an engagement claw to which an urging force is imparted such that a forward end portion of the engagement claw pressurizes the peripheral surface of the reel mounting shaft; and an engagement portion for preventing idle running of the reel is formed at the forward end portion of the engagement claw.

In accordance with the invention as claimed in claim 2 of the present application, a reinforcement binding machine according to claim 1 is characterized in that the portion to be engaged consists of a recess and a protrusion that are formed on the peripheral surface of the reel mounting shaft so as to extend in an axial direction.

In accordance with the invention as claimed in claim 3 of the present application, a reinforcement binding machine according to claim 1 is characterized in that the portion to be engaged is formed by a fitting recess formed in the peripheral surface of the reel mounting shaft, and that the engagement portion is formed by a protrusion to be fitted into the fitting recess.

In accordance with the invention as claimed in claim 4 of the present application, there is provided a reel in which a reel mounting shaft is formed in one of a binding machine main body and a case mounted to the binding machine main body, and in which a reel around which a wire for binding reinforcing bars is wound is attached to the reel mounting shaft, the wire being fed out while rotating the reel to bind the reinforcing bars, characterized in that, on an inner peripheral surface of a hub hole of the reel into which the reel mounting shaft is inserted, there is formed at least one engagement claw to which an urging force is imparted such that its forward end portion is pressed against a peripheral surface of the reel mounting shaft, and that, at a forward end of the engagement claw, there is formed an engagement portion adapted to be engaged with the portion to be engaged with when a pulling-out force for the wire is weakened to thereby prevent idle running of the reel.

In accordance with the invention as claimed in claim 5 of the present application, a reel according to claim 4 is characterized in that the engagement portion of the reel is formed by a protrusion to be fitted into a fitting recess of the reel mounting shaft.

Further, a reel according to one of claims 4 and 5 may be formed as a reel characterized in that the engagement claw is engaged with the reel mounting shaft so as to regulate axial movement of the reel mounting shaft.

BEST MODE FOR CARRYING OUT THE INVENTION

A reinforcement binding machine according to an embodiment of the present invention and a reel used therein will now be described with reference to the drawings.

Figure 11:
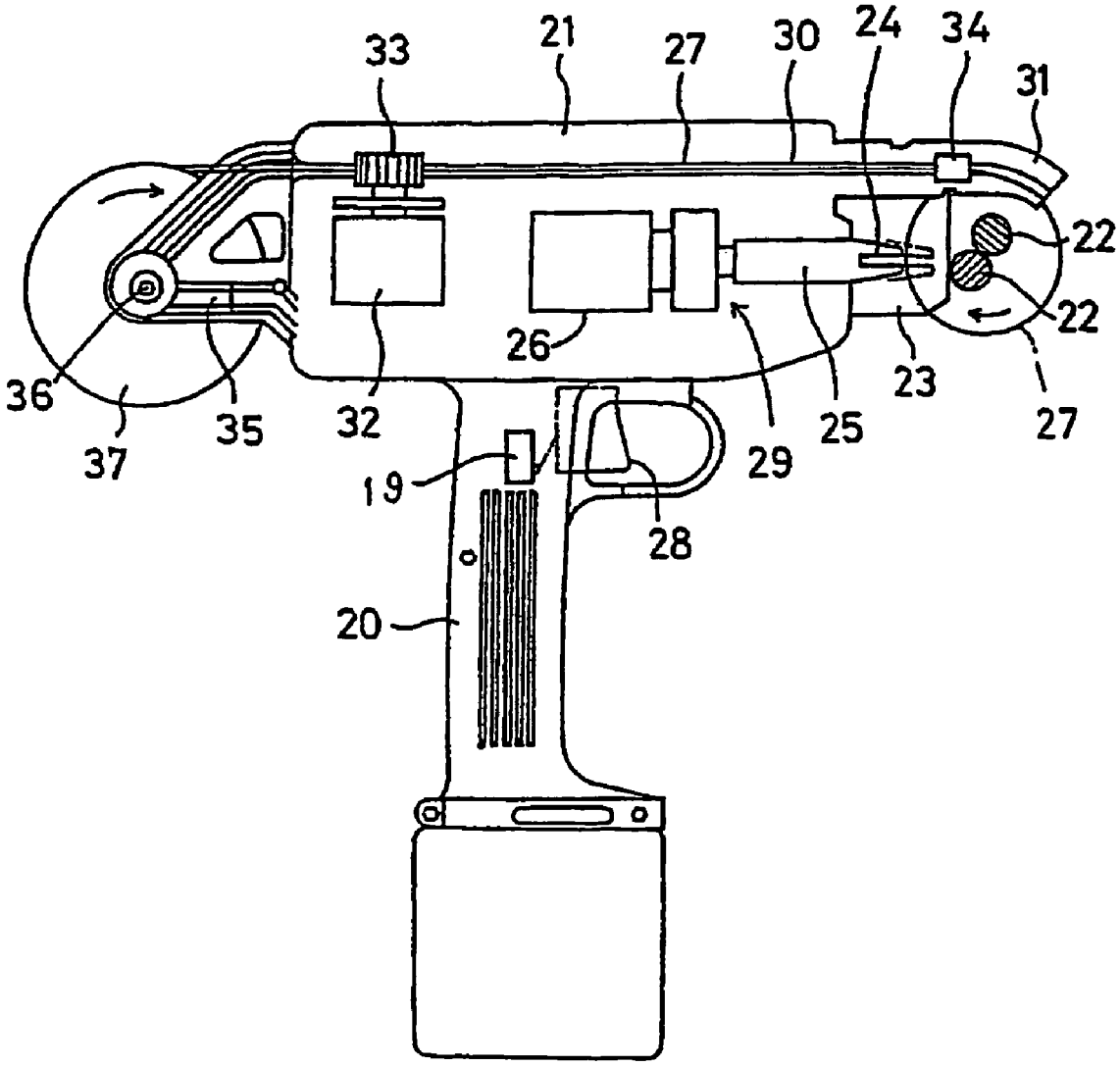
FIG. 11 is a side view of a reinforcement binding machine according to an embodiment of the present invention.
Figure 12:
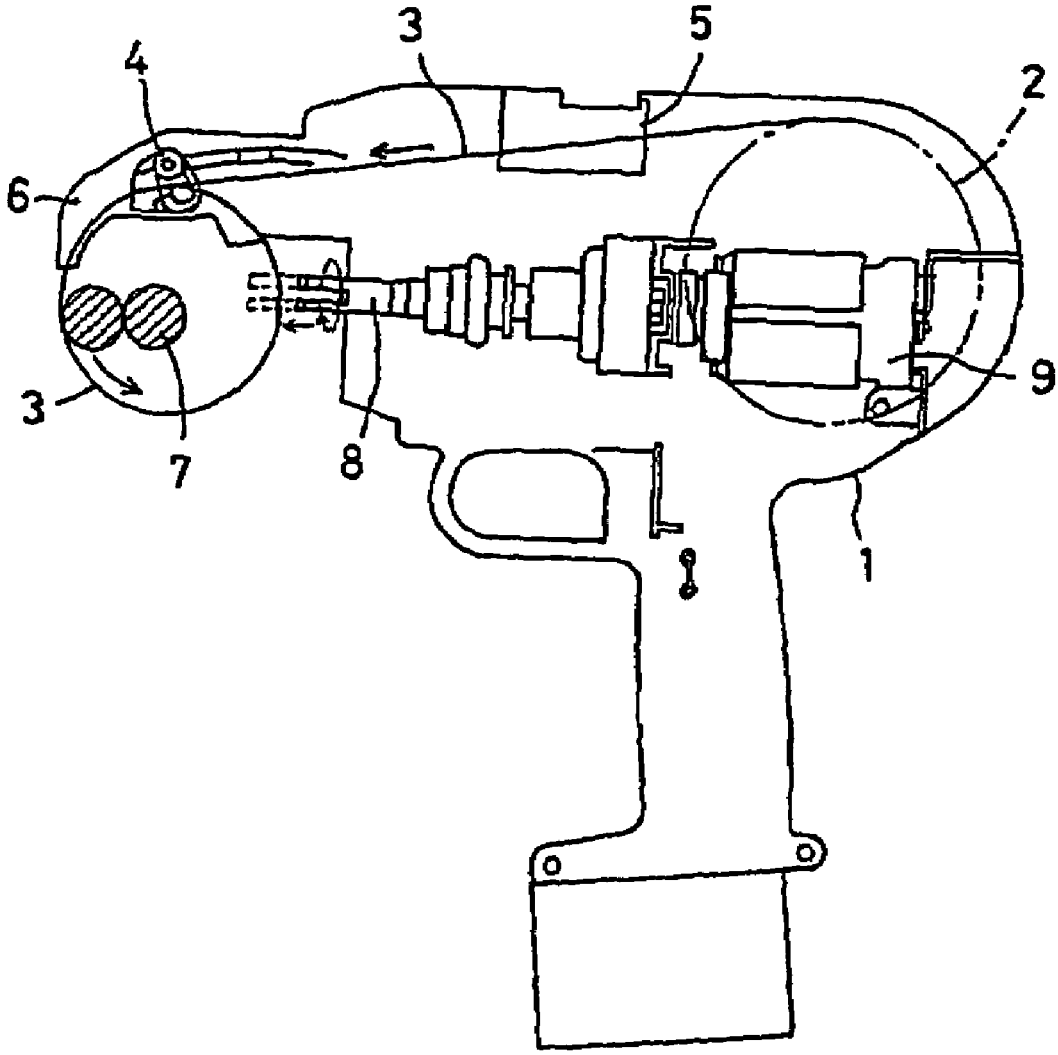
FIG. 12 is a side view of a conventional reinforcement binding machine.
Figure 13:
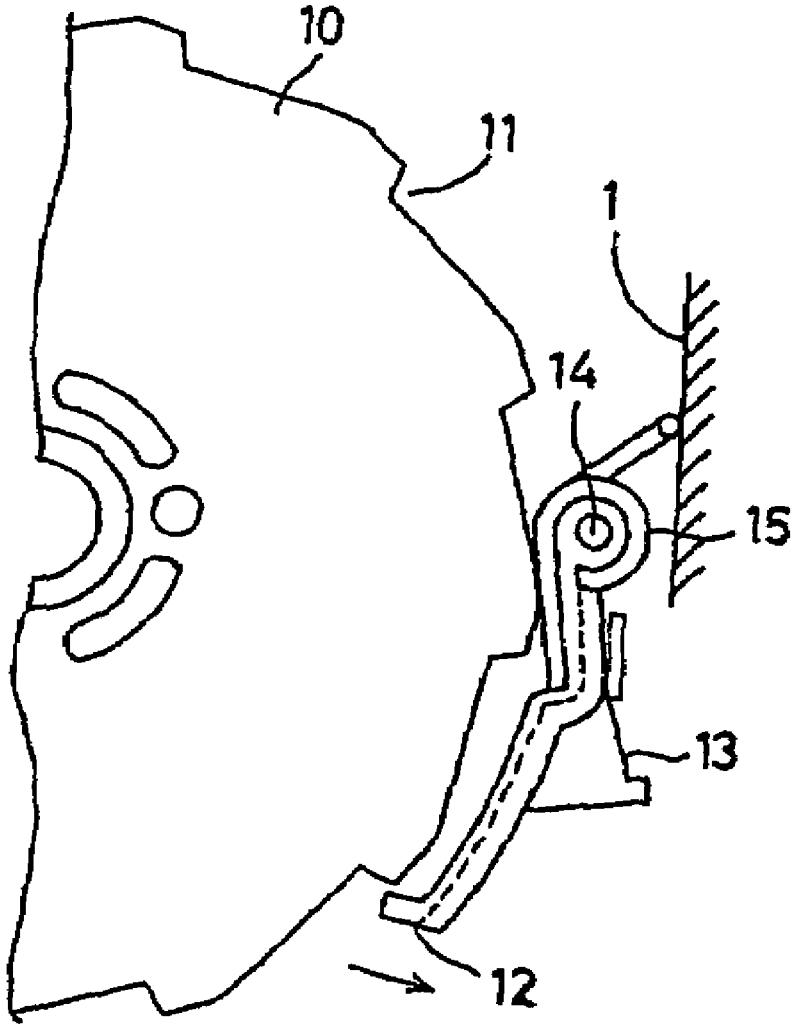
FIG. 13 is a partial enlarged view of a brake mechanism of the reinforcement binding machine of FIG. 12.

FIG. 11 schematically shows the construction of a reinforcement binding machine according to this embodiment.

[Construction of the Reinforcement Binding Machine]

A reinforcement binding machine 20 has, in the lower portion of the forward end portion of a binding machine main body 21 directed toward reinforcing bars 22, a pair of abutment plate portions 23 which are to abut the reinforcing bars 22, and, between the pair of abutment plate portions 23, there is arranged a twisting hook 25 having at its forward end a wire insertion groove 24. The twisting hook 25 can be rotated by an electric motor 26. Prior to the start of the rotation of the electric motor 26, the twisting hook 25 is on standby at a position spaced apart from a wire 27, with the wire insertion groove 24 oriented so as to be parallel to the wire 27 which is in a loop-like form, in order that the wire 27 bent into the loop-like form may be easily inserted into the wire insertion groove 24. The twisting hook 25 is retained by the electric motor 26 through the intermediation of an advancing/retreating mechanism 29. The advancing/retreating mechanism 29 is formed, for example, by a cam mechanism, and is adapted to insert the wire 27 into the wire insertion groove 24 of the twisting hook 25 when the electric motor 26 starts to rotate, causing the twisting hook 25 to retreat to the standby position when the rotation of the electric motor 26 is stopped. That is, when a trigger is pulled to start the rotation of the electric motor 26, the twisting hook 25 extends toward the wire 27, and, after the wire 27 has been inserted into the wire insertion groove 24, the twisting hook rotates, and thereafter, the hook stops its rotation and returns to the standby position.

The binding machine main body 21 is equipped with a wire passage 30 through which the wire 27 is passed. The wire passage 30 extends from the rear end portion of the binding machine main body 21 to the guide portion 31 for curling the wire. The guide portion 31 is arcuately curved, and, in the guide portion 31, the wire passage 30 is in the form of a groove open on the inner side of the arc. In the portion of the wire passage 30 in the rear portion of the binding machine main body 21, there is arranged, as an advancing/retreating mechanism for the wire 27, a gear 33 mounted to an output shaft of a motor 32. The gear 33 faces an opening (not shown) provided in the wire passage 30, and presses the wire 27 against the bottom portion of the wire passage 30, thus effecting feeding and returning of the wire 27. When the micro switch 19 is turned on by the trigger 28, the motor 32 rotates, making it possible to feed the wire 27 to the front or the rear of the binding machine main body 21. The normal/reverse rotation control of the motor 32 is effected by a control circuit (not shown) contained in the binding machine main body 21.

At the position of the wire passage 30 where it reaches the guide portion 31, there is arranged a wire grasping/cutting means 34. The wire grasping/cutting means 34 consists, for example, of a pair of grasping portions and a pair of cutting edges, the wire 27 passing between the pair of grasping portions and between the pair of cutting edges. When the feed amount of wire 27, based on the rotation amount of the motor 32, reaches a predetermined amount, the wire grasping/cutting means 34 grasps the end portion of the wire 27 by the pair of grasping portions. Then, the wire 27, which has been wound around the reinforcing bars 22 while being fed from the gear 33, is rewound by the gear 33 and returned into a reel 38. With the forward end portion of the wire 27, which is wound around the reinforcing bars 22 in a loop form, and the rear end portion of the loop being grasped by the pair of grasping portions, twisting is effected by the twisting hook 25 to bind the reinforcing bars 22, and then the pair of cutting edges are pressed against each other to thereby cut the wire 27.

In the rear end of the binding machine main body 21, there is formed a bearing portion 35 for mounting a reel. In the bearing portion 35, a mounting shaft 36 is provided so as to protrude. A cassette case 37 is detachably mounted to the mounting shaft 36. Inside the cassette case 37, there is mounted the reel 38 (see FIGS. 1 and 2). In the cassette case 37, there is formed an opening (not shown) through which the wire 27 is to be drawn out. The opening of the cassette case 37 faces the wire passage 30.

[Cassette Case]

Figure 1:
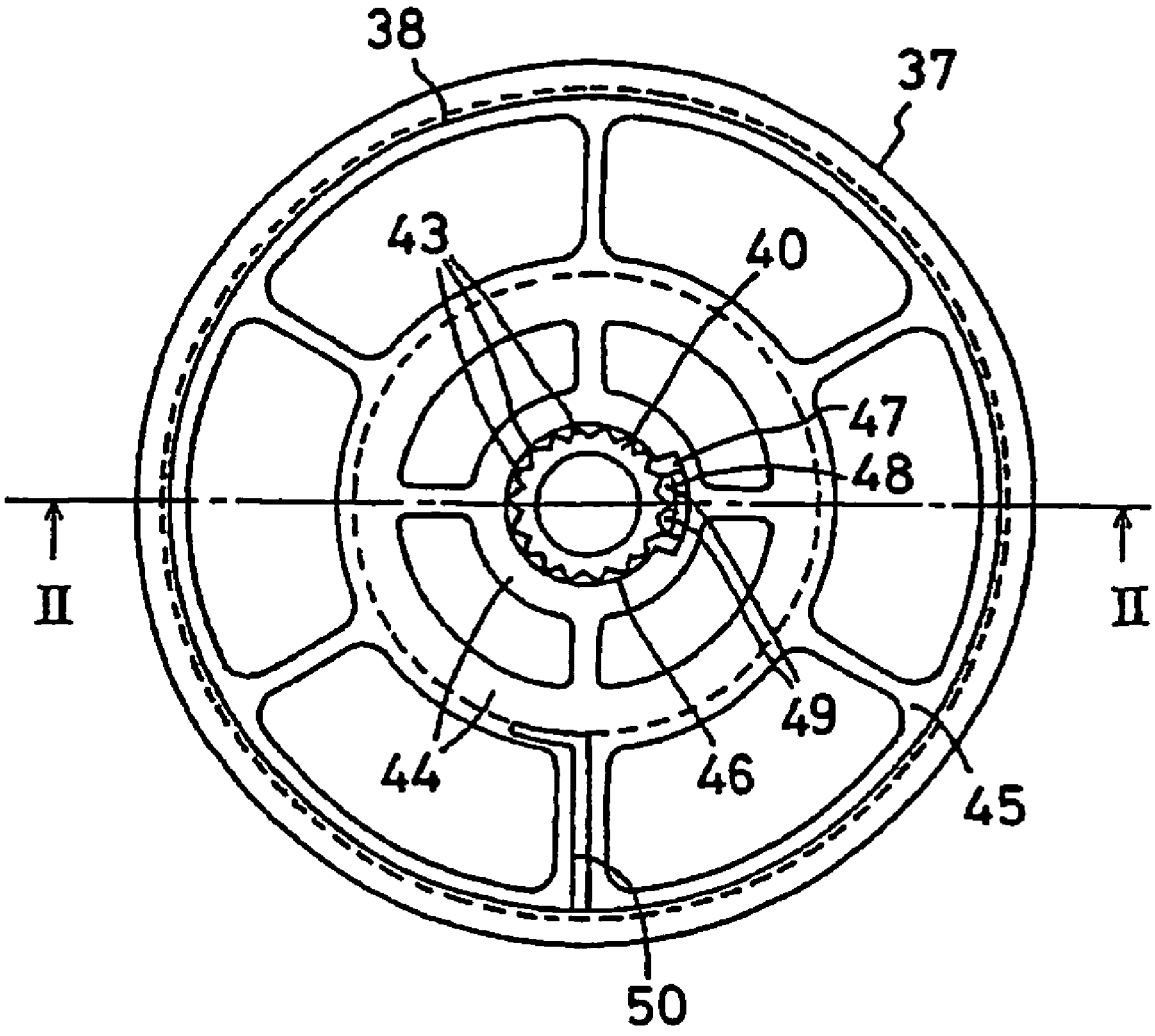
FIG. 1 is a plan view of a reel used in a reinforcement binding machine according to a first embodiment of the present invention.
Figure 2:
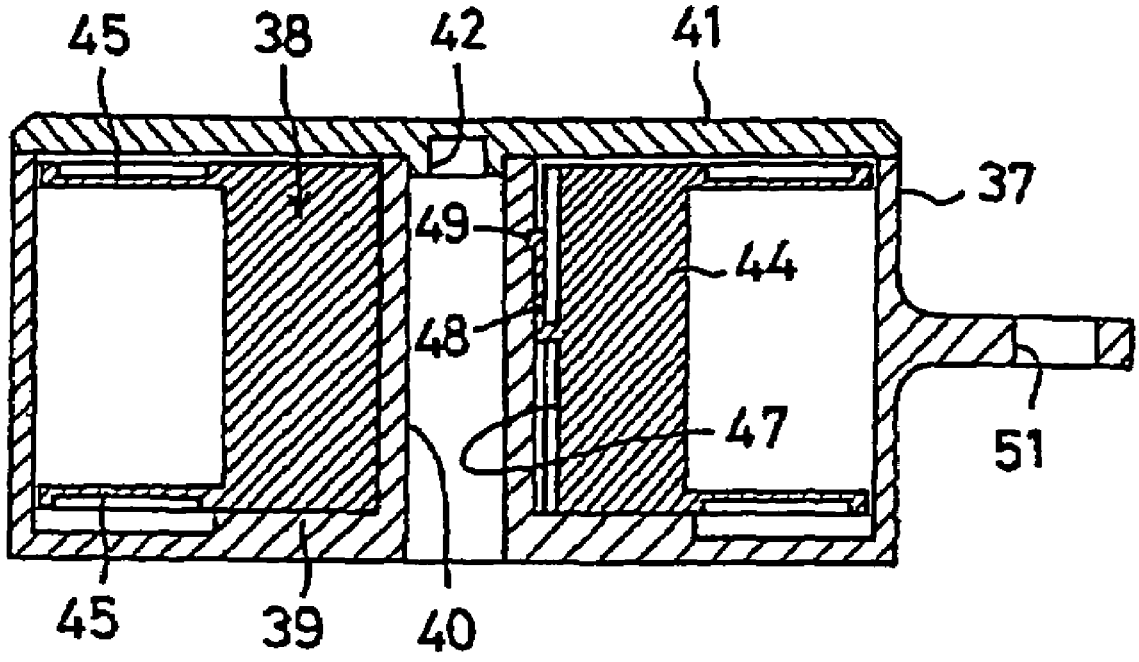
FIG. 2 is a sectional view taken along the line II—II of FIG. 1.

FIGS. 1 and 2 show how the reel 38 is mounted in the cassette case 37. The cassette case 37 is formed of a plastic material superior in resistance to wear and bending, such as polypropylene, and protruding from a bottom portion 39 of the cassette case 37 is a reel mounting shaft 40 through which the mounting shaft 36 of the bearing portion 35 is inserted for fixation. The top portion of the cassette case 37 is open to allow insertion of the reel 38, and the top opening of the cassette case 47 is closed with a cover portion 41. A boss 42 is formed at a central portion on the back of the cover portion 41, and the apex portion of the mounting shaft 36 can be fitted into this boss 42.

On the outer peripheral surface of the reel mounting shaft 40, there are formed axially elongated gear-shaped recesses and protrusions 43 as the portion to be engaged with. While in this embodiment the protrusions and recesses 43 are in a triangular configuration, they may also be in a rectangular, arcuate, or wave-like sectional configuration. Further, while the recesses and protrusions 43 are formed so as extend straight axially over the entire length of the reel mounting shaft 40, they may also cover only a part of the length or may be formed intermittently. When the recesses and protrusions 43 are on the apex portion side with respect to the intermediate portion, it is easy to prevent the reel 38 from being mounted on the wrong side. In order that the reel 38 may be brought closer to the bottom 39 side when drawing out the wire 27, the recesses and protrusions 43 may be formed in a somewhat inclined, spiral configuration. Reference numeral 51 indicates a detent hole for effecting bolt fixation to the binding machine main body 21 side when the reel mounting shaft 40 is attached to the mounting shaft 36.

[Reel]

Figure 3:
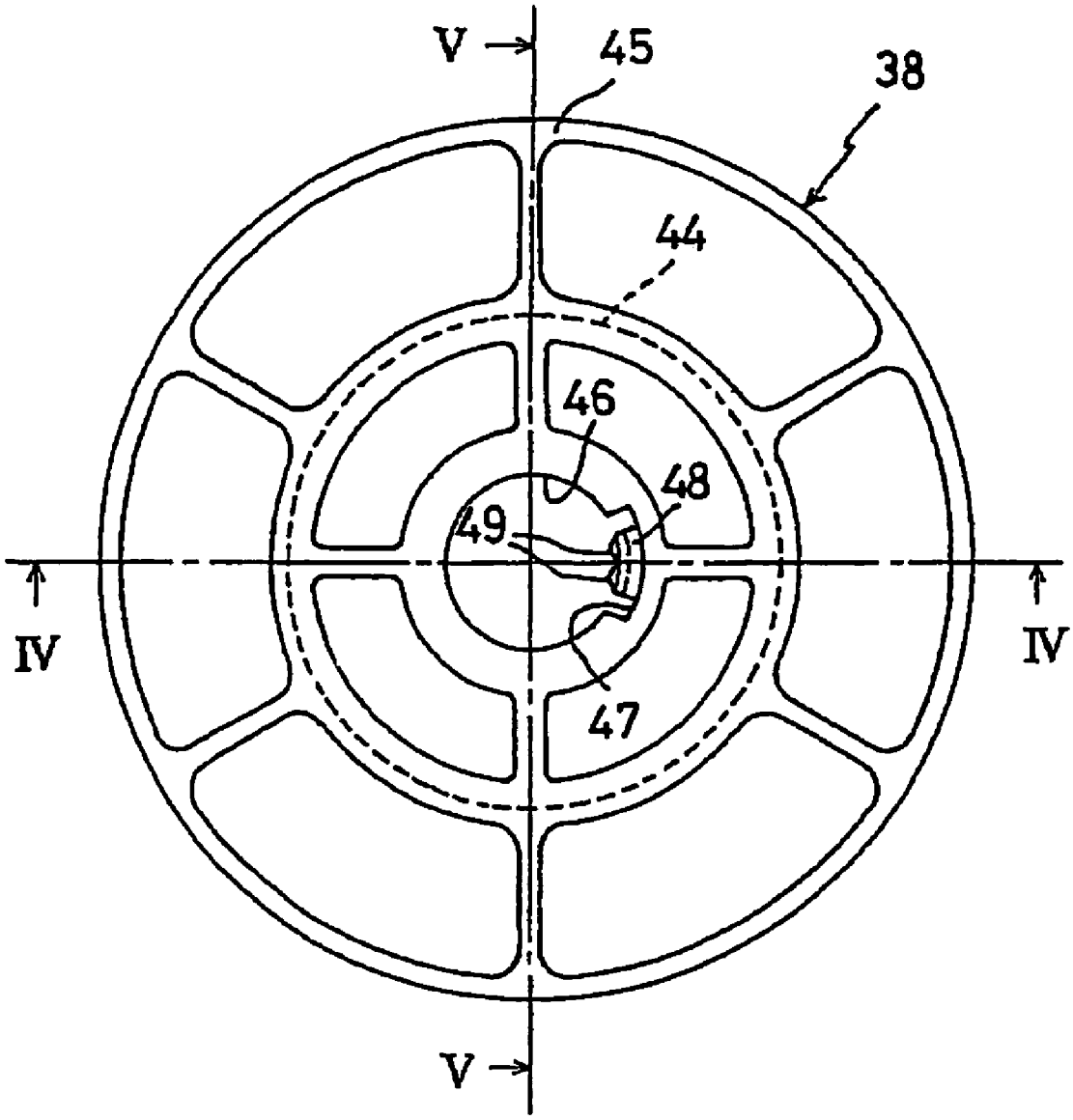
FIG. 3 is a bottom view of the reel of FIG. 1.
Figure 4:
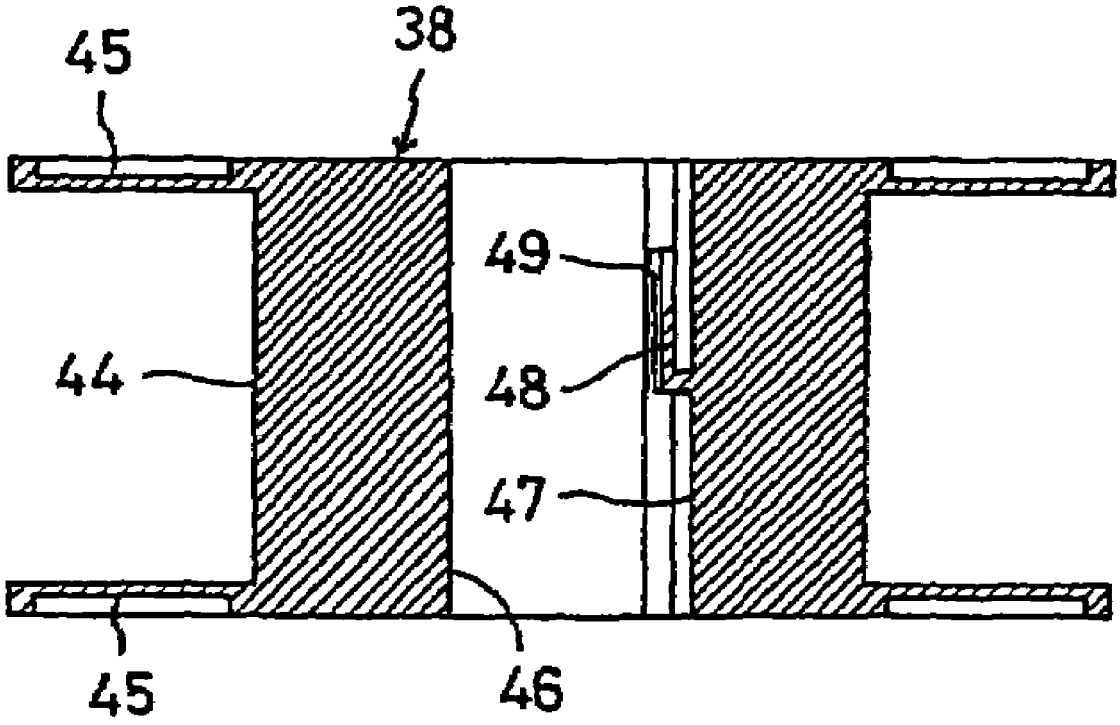
FIG. 4 is a sectional view taken along the line IV—IV of FIG. 3.
Figure 5:
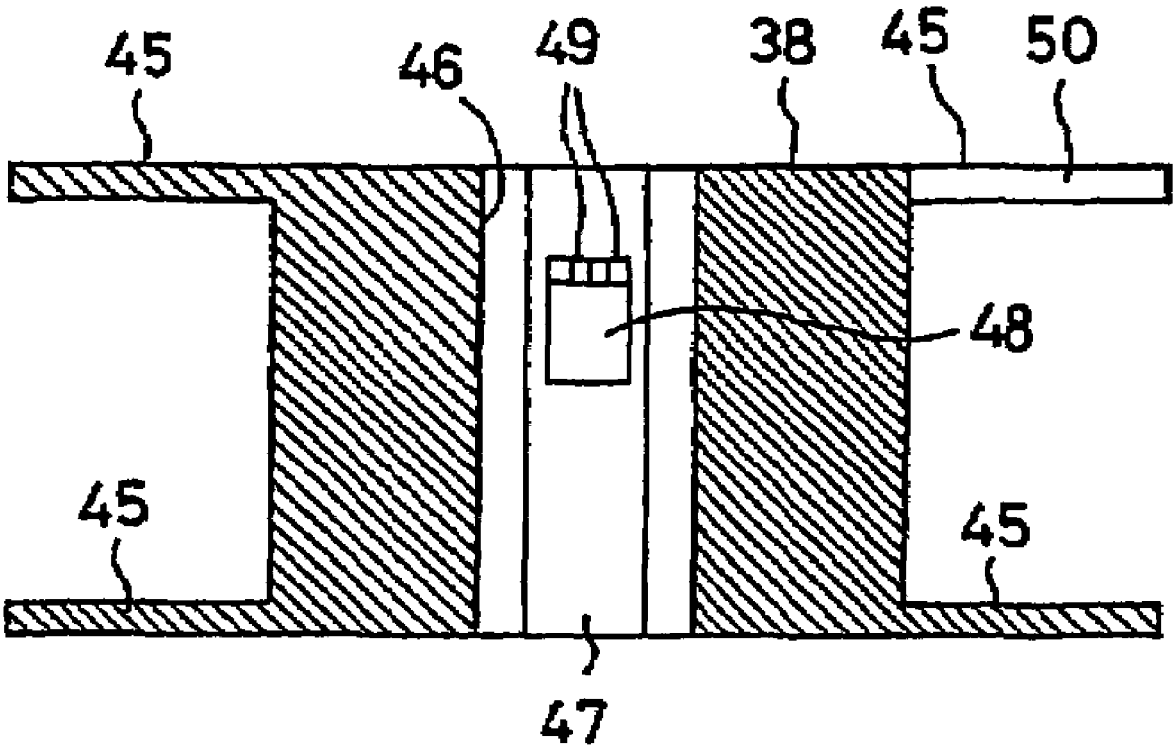
FIG. 5 is a sectional view taken along the line V—V of FIG. 3.

FIGS. 3 through 5 show the configuration of the reel 38. The reel 38 is formed of a plastic material superior in resistance to wear and bending, such as polypropylene; the wire 27 is wound around the reel 38 and can be moved to the front or to the rear of the binding machine main body 21 through the feeding by-the gear 33. The reel 38 is capable of rotation in the normal and reverse directions according as the wire 27 is fed out or rewound.

The reel 38 has a hub portion 44 around which the wire 27 is wound, and flanges 45. In the hub portion 44, there is formed a hub hole 46 into which the reel mounting shaft 40 is inserted, and a recess 47 is formed in a part of the inner peripheral surface of the hub hole 46, with the engagement claw 48 being formed in the recess 47.

The engagement claw 48 extends outward from the intermediate portion of the recess 47 toward the opening on the flange 45 side; at the same time, it extends along the reel mounting shaft 40 after being raised from the recess 47. The engagement claw 48 has at its forward end an engagement portion 49 protruding in the direction of the center of the hub hole 46. While the engagement portion 49 has a triangular configuration in plan view so as to be in mesh with the recesses and protrusions 43 of the reel mounting shaft 40, the engagement portion 49 may also have a circular configuration.

The engagement claw 48 is formed so as to be somewhat oblique toward the center of the hub hole 46 so that an elastic force may be generated by the reel mounting shaft 40 when the mounting to the reel mounting shaft 40 is effected, the recesses and protrusions of the engagement portion 49 being fitted into the recesses and protrusions 43 for meshing engagement.

The elastic force of the engagement claw 48 is such that it allows rotation of the reel 38 when drawing out the wire 27 and that it causes the engagement portion 49 to be brought into mesh with the recesses and protrusions 43 when the drawing-out of the wire 27 is canceled. Further, the engagement portion 49 is formed at the forward end of the engagement claw 48, causing the recesses and protrusions 43 to be easily got over when the reel 38 is rotated when drawing out the wire.

Further, due to the above construction, when the wire 27 once drawn out is returned into the cassette case 37 by rewinding the wire 27, the reel 38 is pushed back to rotate reversely by the wire 27 thus returned. That is, the wire 27 is drawn back into the space formed between the cassette case and the reel 27, and due to the rigidity of the wire 27, the wound wire 27 is pushed back, whereby the reel 38 rotates in the reverse direction. As a result of this reverse rotation of the reel 38, bending of the returned wire 27 is prevented, and it is possible to prevent malfunction during wire feeding caused by bending of the wire 27.

The flanges 45 of the reel 38 are formed respectively at the top and the bottom of the hub portion 44, and the reel 38 regulates deviation in the thickness direction of the wire 27 wound around the hub portion 44. Lightening is effected as much as possible on the flanges 45 such that a pulling force can be applied by inserting the finger into a light hole when replacing the reel 38 or the angle at which the reel 38 is stopped can be adjusted with ease, while achieving a reduction in cost and weight. Formed in one of the flanges 45 is a mounting groove 50 for securing the winding start end portion of the wire 27.

While in the above embodiment the reel 38 is stored inside the case 37 constituting a part of the reinforcement binding machine 20, it is also possible to use the mounting shaft 36 of the reinforcement binding machine 20 as the reel mounting shaft and to form the above-mentioned recesses and protrusions 43 on the outer peripheral surface of the mounting shaft 36, attaching the mounting shaft 36 directly to the hub hole 46 of the reel 38.

[Second Embodiment]

FIGS. 6 through 10 show another embodiment of the reinforcement binding machine and the reel. A cassette case 60 constitutes a part of the reinforcement binding machine 20.

[Cassette Case]

Figure 6:
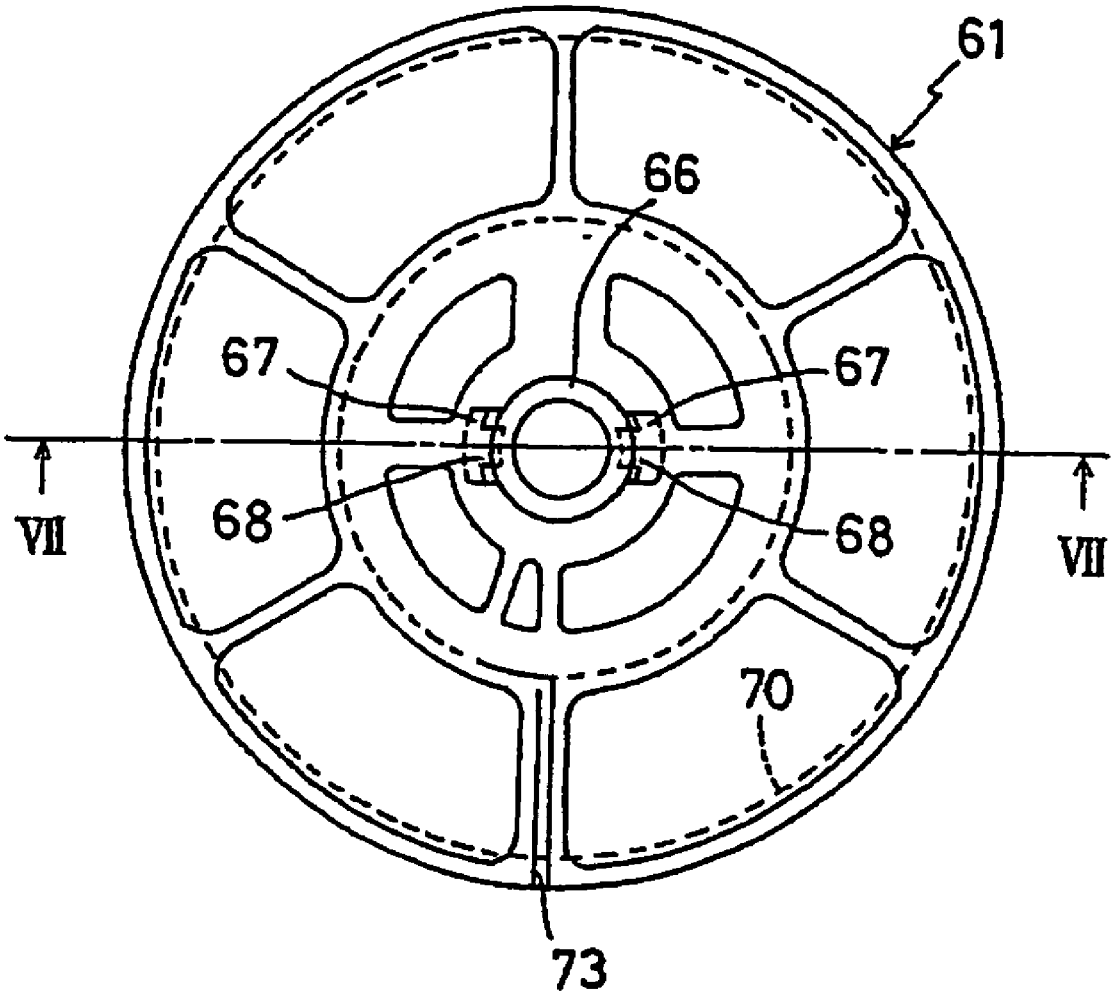
FIG. 6 is a plan view of a reel used in a reinforcement binding machine according to a second embodiment of the present invention.
Figure 7:
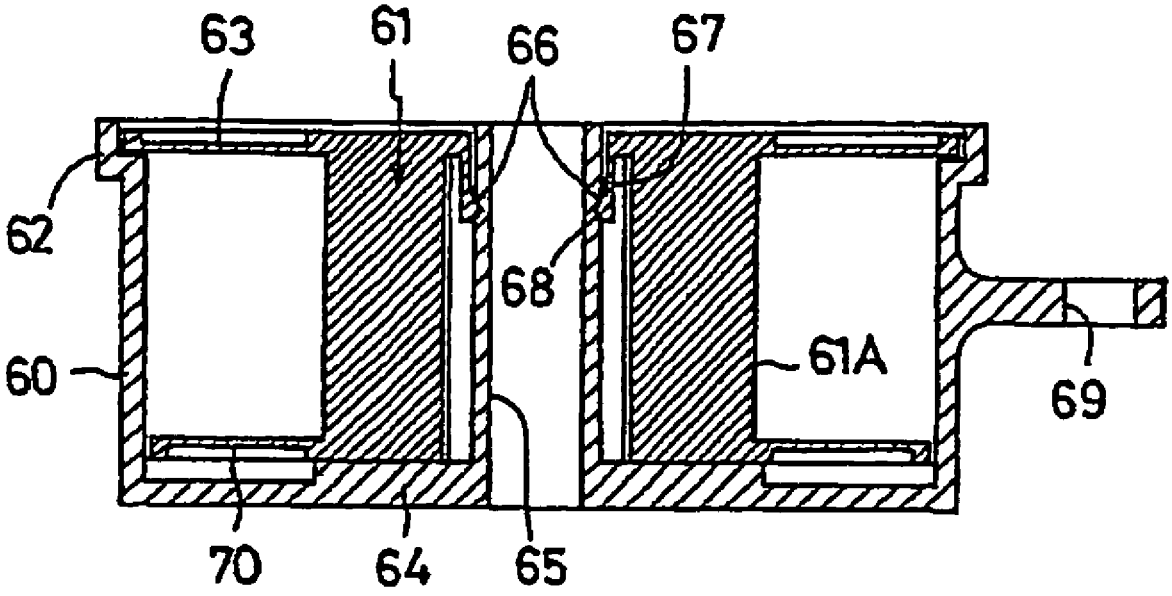
FIG. 7 is a sectional view taken along the line VII—VII of FIG. 6, showing a state in which the reel of FIG. 6 is placed inside a cassette case.
Figure 8:
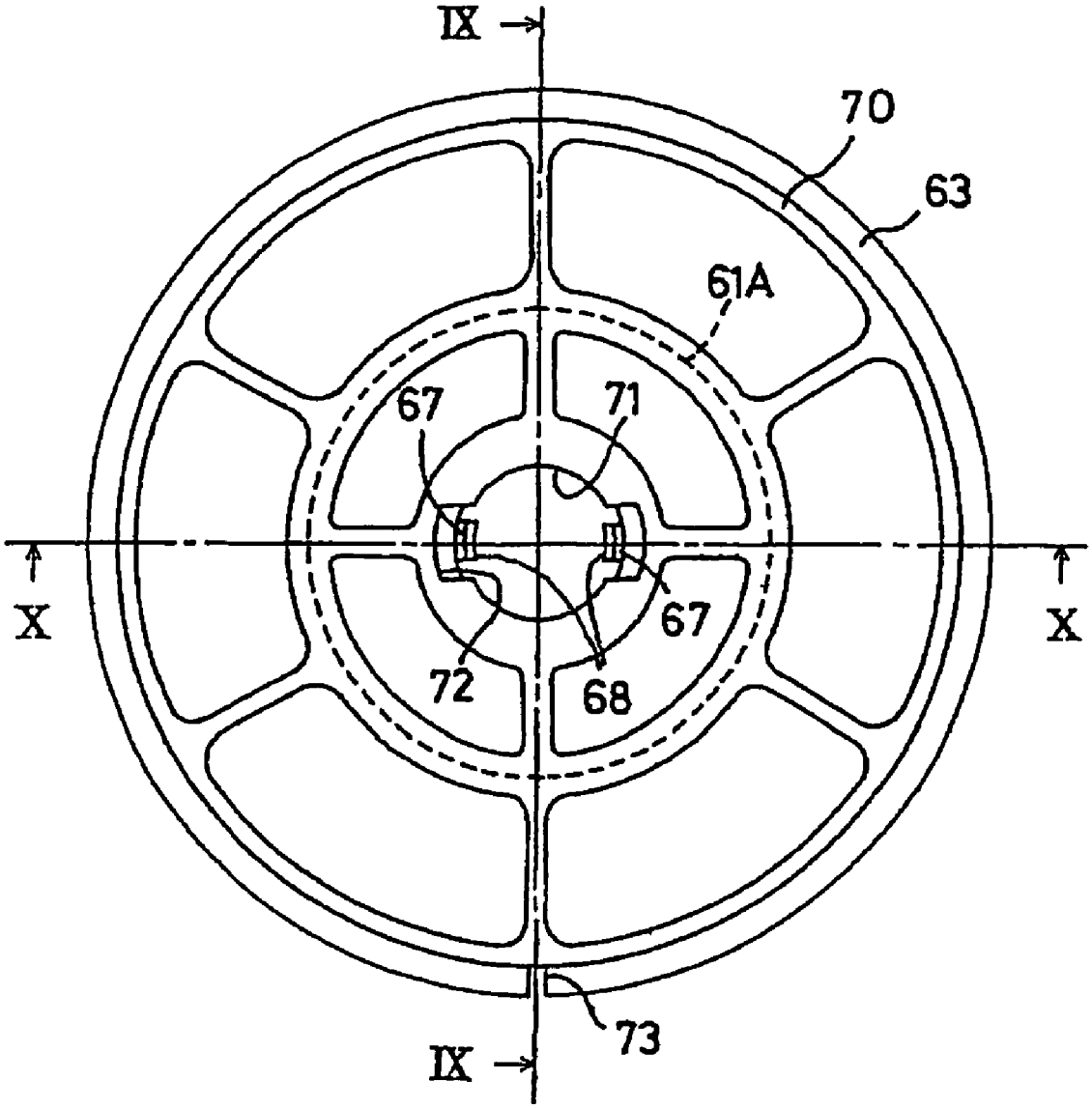
FIG. 8 is a bottom view of FIG. 6.
Figure 9:
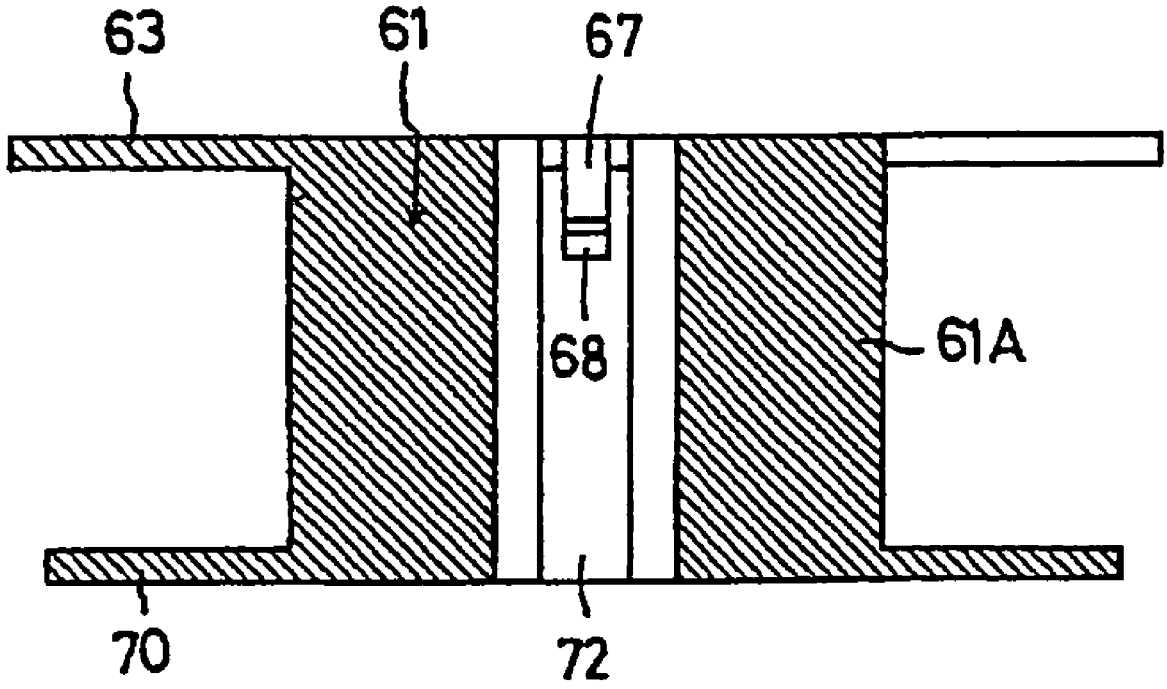
FIG. 9 is a sectional view taken along the line IX—IX of FIG. 8.
Figure 10:
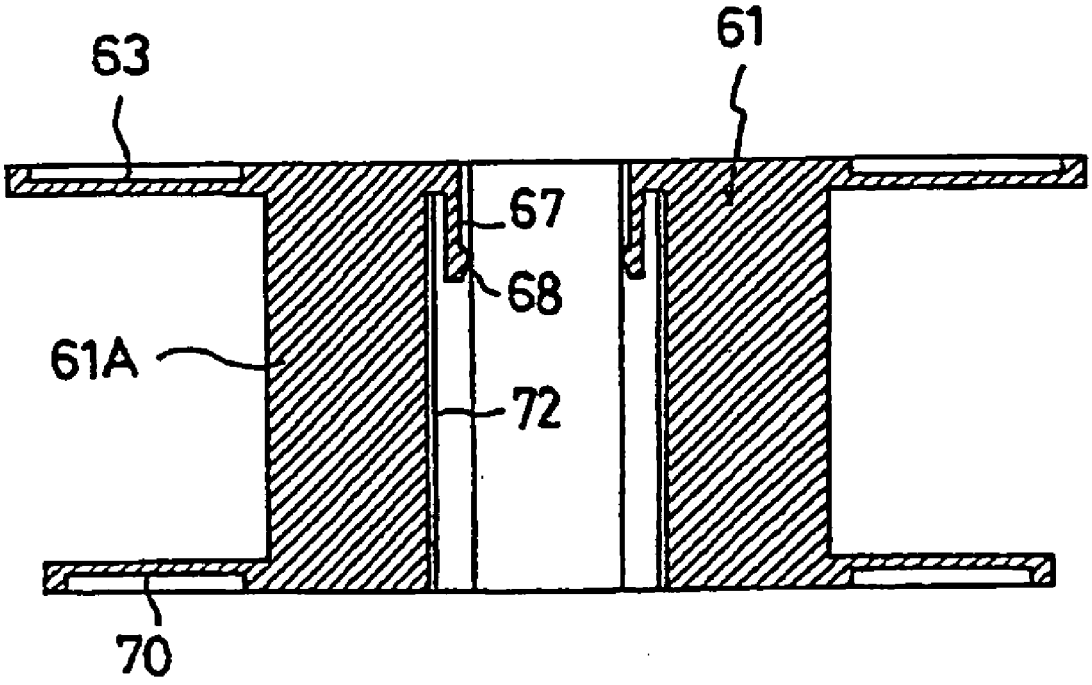
FIG. 10 is a sectional view taken along the line X—X of FIG. 8.

FIGS. 6 and 7 show how a reel 61 is mounted in the cassette case 60. The cassette case 60 is formed of a plastic material superior in resistance to wear and bending, such as polypropylene, and protruding from a bottom portion 64 of the cassette case 60 is a reel mounting shaft 65 through which the mounting shaft 36 of the bearing portion 35 is inserted for fixation.

The upper portion of the cassette case 60 is open to allow insertion of the reel 61, and a step portion 62 is formed in the edge portion of this opening. Fitted into the inner side of the step portion 62 is the outer edge portion of a large flange 63 of the reel 61, and the opening of the cassette case 60 is closed by the outer edge portion of the large flange 63, preventing the wire 27 from coming out of the large flange 63.

A cylindrical reel mounting shaft 65, into which the mounting shaft 36 is inserted, protrudes from the bottom portion 64 of the cassette case 60. In an outer peripheral surface of the reel mounting shaft 65, there is formed a fitting recess 66 extending in a ring-like form around the axis of the reel mounting shaft 60. While in this embodiment the fitting recess 66 is formed in a ring-like form, two to eight fitting recesses 66 may be formed at equal angles.

The fitting recess 66 prevents the reel 61 from being detached from the cassette case 60, and by fitting the engagement portion 68 of the engagement claw 67 of the reel 61 into the fitting recess 66, the reel 61 is maintained at a fixed height of the reel mounting shaft 65.

Reference numeral 69 indicates a detent hole for effecting bolt fixation to the binding machine main body 21 side when the cassette case 60 is attached to the mounting shaft 36.

[Reel]

FIG. 6 and FIGS. 8 through 10 show the configuration of the reel 61. The reel 61 is formed of a plastic material superior in resistance to wear and bending, such as polypropylene; the wire 27 is wound around the reel 61 and can be moved to the front or to the rear of the binding machine main body 21 through the feeding by the gear 33. The reel 61 is capable of rotation in the normal and reverse directions as the wire 27 is fed out or rewound.

The reel 61 has a hub portion 61A around which the wire 27 is wound, the large flange 63, and a small flange 70. The large flange 63 is formed so as to be situated on the opening side of the cassette case 60, and the small flange 70 is formed so as to be situated on the bottom 64 side of the cassette case 60. By providing the large flange 63 on one side of the hub portion 61A (see FIG. 7), even if a molding taper is formed on the peripheral wall of the cassette case 60, the wire 27 is prevented from being detached since the large flange 63 closes the gap between the peripheral wall of the cassette case 60 and the reel.

At the center of the hub portion 61A, there is formed a hub hole 71 into which the reel mounting shaft 65 is inserted, and a pair of recesses 72 are formed in the inner peripheral surface of the hub hole 71 at positions opposed to each other, with an engagement claw 67 being formed in each recess 72.

The engagement claws 67 extend toward the intermediate portion of the hub portion 61A from the hub hole opening edge portion on the large flange 63 side; at the same time, they extend along the reel mounting shaft 65 after being raised from the recesses 72, the engagement claws having at their forward ends engagement portions 68 protruding in the direction of the center of the hub hole 71. The engagement portions 68 have a rectangular configuration so as to be fitted into a fitting recess 66 of the reel mounting shaft 65. The fitting recess 66 has a rectangular sectional configuration, and is, as stated above, formed in a ring-like shape to surround the outer periphery of the reel mounting shaft 65; the fitting recess may also consist of recesses formed at positions spaced apart from each other.

The engagement claws 67 are formed so as to be somewhat oblique toward the center of the hub hole 71 so that an elastic force may be generated by the reel mounting shaft 65 when the mounting to the reel mounting shaft 65 is effected, the engagement portions 68 being fitted into the fitting recess 66. Of course, the direction in which the engagement claws 67 extend may not be oblique.

Further, the elastic force of the engagement claws 67 has a frictional resistance allowing the reel 61 to rotate when the wire 27 is to be drawn out and stopping the reel 61 when the drawing-out of the wire 27 is canceled. Further, each engagement portion 68 is formed at the forward end of the engagement claw 67, and slides along the fitting recess 66 when the reel 61 rotates as the wire is drawn out. Since the fitting recess 66 is formed in a ring-like shape, the engagement claws 67 can be attached to the reel mounting shaft 65 at any angle.

In the case in which the fitting recesses 66 consist of recesses formed at intervals in the outer periphery of the reel mounting shaft 65, when the reel 61 rotates, the engagement claws 67 get over the edges of the fitting recesses 66 to be fitted again into the fitting recesses 66, so that intermittent stopping is possible when rotating the reel 61. Further, it is also possible to form a plurality of protrusions at the bottom of the ring-like fitting recess 66 along the periphery of the reel mounting shaft 65.

The large flange 63 and the small flange 70 regulate deviation in the thickness direction of the wire 27 wound around the hub portion 61A. Lightening is effected as much as possible on the large and small flanges 63 and 70 in order to achieve a reduction in cost and weight. Formed in the large flange 63 is a mounting groove 73 for securing the winding start end portion of the wire 27.

While in the above embodiment the reel 61 is accommodated inside the case 60 constituting a part of the reinforcement binding machine 20, it is also possible to use the mounting shaft 36 of the reinforcement binding machine 20 as the reel mounting shaft and to form in the outer peripheral surface of the mounting shaft 36 a plurality of the fitting recesses 66 as mentioned above, attaching the mounting shaft 36 directly to the hub hole 71 of the reel 61.

Of the reel mounting shaft, the lower portion on the bottom side of the cassette case 60 and the upper portion on the opening side of the cassette case 60 have different diameters, the upper portion of the reel mounting shaft having a large diameter and the lower portion of the reel mounting shaft having a small diameter to thereby form a step portion in the reel mounting shaft; at the same time, a recess or a protrusion for engagement may be formed on the outer peripheral surface of the lower portion with a smaller diameter, and the engagement claws 67 of the reel 61 extend from the forward end side of the reel mounting shaft toward the lower portion with a smaller diameter, with the engagement claws 67 being hooked on the corner portion of the step portion and the forward end portions of the engagement claws 67 being engaged with the recess or protrusion in the small diameter portion of the reel mounting shaft, thereby mounting the reel to the reel mounting shaft so as to be detachable and capable of intermittent rotation.

[Effects of the Invention]

In the reinforcement binding machine as claimed in claims 1 through 3 and the reel as claimed in claims 4 and 5 of the present application, when the engagement portion of the engagement claw on the inner peripheral surface of the hub hole of the reel is in contact with the recess to be engaged of the reel mounting shaft, if tensile force in the feed-out direction or the draw-back direction is applied to the wire, the engagement portion and the portion to be engaged are solely in contact with each other, allowing the reel to rotate in both the normal and reverse directions. When the tensile force applied in the feed-out direction or the draw-back direction for the wire is weakened, the engagement portion and the portion to be engaged are engaged with each other so as to effect hooking without involving any deviation, so that no idle running of the reel occurs.

Due to this arrangement, the reel is allowed to rotate in both the normal and reverse directions, and when the force applied to the wire is eliminated or weakened, the reel is locked, thus preventing wire entanglement.

In the reinforcement binding machine as claimed in claim 2 of the present application, the axially elongated recesses and protrusions are formed on the peripheral surface of the reel mounting shaft, so that, when the wire is pulled in the forward or reverse direction, the engagement claw slips on the surface of the protrusions to allow the reel to rotate, and when the tensile force in the forward or reverse direction applied to the wire is eliminated or weakened, the engagement claw enters the recess to thereby prohibit rotation of the reel.

In the reinforcement binding machine as claimed in claim 3 of the present application, the fitting recesses are formed on the peripheral surface of the reel mounting shaft, so that, when the wire is pulled in the forward or reverse direction, the engagement claw slips on the surface of the protrusions to allow the reel to rotate, and when the tensile force in the forward or reverse direction applied to the wire is eliminated or weakened, the engagement claw enters the fitting recess to thereby prohibit rotation of the reel.

In the reel as claimed in claim 4 of the present application, when the engagement portion of the engagement claw on the inner peripheral surface of the hub hole of the reel is in contact with the recess to be engaged of the reel mounting shaft, if a tensile force in the feed-out direction or the draw-back direction is applied to the wire, the engagement portion and the portion to be engaged are solely in contact with each other, allowing the reel to rotate in both the normal and reverse directions. When the tensile force applied in the feed-out direction or the draw-back direction for the wire is weakened, the engagement portion and the portion to be engaged are engaged with each other so as to effect hooking without involving any deviation, so that no idle running of the reel occurs. Thus, the reel is allowed to rotate in both the normal and reverse directions, and when the force applied to the wire is eliminated or weakened, the reel is locked, thus preventing wire entanglement.

In the reel as claimed in claim 5 of the present application, the reel is prevented from being detached in the axial direction of the reel mounting shaft.

INDUSTRIAL APPLICABILITY

The present invention provides a technique applicable to prevention of malfunction in reinforcement binding.

The invention claimed is:

1. A reinforcement binding machine comprising:

a binding machine main body and optionally a case mounted to the binding machine main body;

a reel mounting shaft is formed in one of the binding machine main body and the case mounted to the binding machine main body;

a reel around which a wire for binding reinforcing bars is wound is attached to the reel mounting shaft, the reinforcing bars being bound by the wire fed out from the reel, the reel including a hub and a hub hole in the hub that is adapted to receive the reel mounting shaft;

on a peripheral surface of the reel mounting shaft, there is formed a portion to be engaged comprising at least one of a recess and a protrusion;

on an inner peripheral surface of the hub hole into which the reel mounting shaft of the reel is inserted, there is formed an engagement claw to which an urging force is imparted such that an end portion of the engagement claw is biased against the peripheral surface of the reel mounting shaft; and an engagement portion is formed at the end portion of the engagement claw for engaging with the portion on the reel mounting shaft to prevent idle running of the reel.

2. The reinforcement binding machine according to claim 1, wherein the portion to be engaged comprises a recess and a protrusion on the peripheral surface of the reel mounting shaft extending in an axial direction.

3. The reinforcement binding machine according to claim 1, wherein the portion to be engaged is a recess formed in the peripheral surface of the reel mounting shaft, and that the engagement portion is a protrusion adapted to fit into the recess.

4. A reel for a binding machine, the reel comprising:

a space in which a wire for binding reinforcing bars is wound, the reinforcing bars being bound by the wire fed out from the reel;

a hub having a hub hole that is adapted to receive a reel mounting shaft that is formed in one of a main body of the binding machine and a case mounted to the binding machine main body in an inner peripheral surface of the hub hole into which the reel mounting shaft is inserted, there is at least one engagement claw having an end portion to which an urging force is imparted so as to press the end portion of the engagement claw against a peripheral surface of the reel mounting shaft, and an engagement portion for preventing idle running of the reel is formed at the end portion of the engagement claw.

5. The reel according to claim 4, wherein the engagement claw is engaged with the reel mounting shaft so as to regulate axial movement of the reel mounting shaft.

6. A reinforcement binding machine comprising:

a binding machine main body and optionally a case mounted to the binding machine main body;

a reel mounting shaft is formed in one of the binding machine main body and the case mounted to the binding machine main body;

a reel around which a wire for binding reinforcing bars is wound is attached to the reel mounting shaft, the reinforcing bars being bound by the wire fed out from the reel, the reel including a hub and a hub hole in the hub that is adapted to receive the reel mounting shaft;

on one of a peripheral surface of the reel mounting shaft and an inner peripheral surface of the hub hole, there is formed a portion to be engaged comprising at least one of a recess and a protrusion;

on one of the peripheral surface of the reel mounting shaft and the inner peripheral surface of the hub hole into which the reel mounting shaft of the reel is inserted, there is formed an engagement claw to which an urging force is imparted such that an end portion of the engagement claw is biased against the portion to be engaged; and an engagement portion is formed at the end portion of the engagement claw for engaging with the portion to be engaged to prevent idle running of the reel.

* * * * *